US005148207A

United States Patent [19]

Tanamachi

[11] Patent Number: 5,148,207

[45] Date of Patent: Sep. 15, 1992

[54] CAPACITIVE FILM POSITION SENSING SYSTEM FOR A FILM PROCESSOR

[75] Inventor: Steven W. Tanamachi, Lauderdale, Minn.

[73] Assignee: Minnesota Mining and Manufacturing Company, St. Paul, Minn.

[21] Appl. No.: 687,285

[22] Filed: Apr. 18, 1991

[51] Int. Cl.[5] ..... G03D 3/08

[52] U.S. Cl. ..... 354/322

[58] Field of Search ..... 354/322, 323; 355/27; 271/267; 340/563, 675; 324/670, 671, 674

[56] References Cited

U.S. PATENT DOCUMENTS

| | | | |
|---|---|---|---|
| 3,600,676 | 8/1971 | Lugwig et al. | 324/61 R |
| 3,841,610 | 10/1974 | Hanzawa et al. | 366/77 |
| 4,837,499 | 6/1989 | Scherer, III | 324/61 P |
| 5,035,415 | 7/1991 | Lee | 271/265 |

FOREIGN PATENT DOCUMENTS

| | | |
|---|---|---|
| 833226 | 6/1983 | South Africa . |
| 2083663 | 3/1982 | United Kingdom . |

*Primary Examiner*—L. T. Hix
*Assistant Examiner*—D. Rutledge
*Attorney, Agent, or Firm*—Gary L. Griswold; Walter N. Kirn; Walter C. Linder

[57] ABSTRACT

A photographic media position sensing system for use in conjunction with a media processor of the type including a plurality of processing tanks for holding baths of conductive liquid media developing chemicals and a transport mechanism for driving the media through and between the processing tanks. The system includes a plurality of sensing electrodes, each of which is positioned adjacent to one of the processing tanks. One or more ground electrodes are positioned within the processing tanks for making electrical contact with the baths of developing chemicals. Media sensor circuits are connected between the ground electrodes and sensing electrodes. The media sensor circuits provide sensed media signals representative of the presence of media between the sensing electrode and adjacent processing chemical bath as a function of the capacitance between the sensing and ground electrodes. Location identifying circuitry is coupled to the media sensor circuits and provides media location signals as a function of the sensed media signals. A visual display of the positions of the media within the processing tanks is provided by a display interfaced to the location identifying circuitry.

23 Claims, 5 Drawing Sheets

CAPACITIVE FILM POSITION SENSING SYSTEM FOR A FILM PROCESSOR

REFERENCE TO CO-PENDING APPLICATION

Reference is hereby made to commonly assigned co-pending application Ser. No. 687,170 entitled Two-Part Sensor With Transformer Power Coupling and Optical Signal Coupling, filed on even date herewith.

BACKGROUND OF THE INVENTION

The present invention relates generally to sensors for media processing systems. In particular, the present invention is a capacitive sensing system for monitoring the locations of photographic film within an automatic film processor.

Automatic photographic film processing systems include a number of tanks which contain baths of liquid developing chemicals. Transport mechanisms which include driven rollers and guides are removably fitted within the tanks. Sheets of film are developed as they are driven through the tanks by the transport mechanisms. The sheets of film are guided between the transport mechanisms of adjacent tanks by crossover guides.

Sheets of film will occasionally get jammed within the transport mechanisms, or slide out of the transport mechanisms and into the tanks of developing chemicals. The operator of the film processor is alerted to these jammed and loose film occurrences by a film transport sensing system. Sensing systems of this type typically include sensors at the film input and output points of the processor. The sensors are coupled to a control system which is programmed with information characterizing the time it is expected to take the transport mechanisms to drive sheets of film between the input and output points. Jammed or loose film conditions are identified when the elapsed time between the receipt of detection signals from the input and output sensors exceeds the expected transport time. The control system stops the transport mechanisms and activates an alarm to alert the operator when these conditions are detected.

Since the processing tanks are relatively deep, the location of the jammed or loose film is often not immediately evident to the operator. A number of transport mechanisms must then be removed or disassembled to locate and correct the problem. This is an inconvenient task since the developing chemicals are corrosive and dangerous. This task can also result in damage to non-affected films within the processor.

The hostile environment within the processor also places constraints on the types of sensors which can be incorporated into the sensing system. Since the wet emulsion on the sheets of film is very soft, it can be scratched by physical contact sensors. Photoelectric detectors can cause undesired light fogging of the film.

It is evident that there is a continuing need for improved film position sensing systems and sensors used with the systems. The sensors must be relatively inexpensive, yet capable of accurately and non-destructively identifying the presence of film. A system which could pinpoint the location of jammed or loose film conditions within the processor would be especially desirable. Any such system and sensors must also be capable of withstanding the hostile chemical environment within the film processor.

SUMMARY OF THE INVENTION

The present invention is an accurate, non-destructive, corrosion resistant media position sensing system for use in conjunction with a media processor of the type including a first processing tank for holding a first bath of conductive media processing liquid. The media position sensing system includes a first sensing electrode and a first ground electrode. The sensing electrode is adjacent to the processing tank, while the ground electrode is positioned within the tank to make electrical contact with the bath of processing liquid. A first capacitive media sensor circuit is coupled between the ground and sensing electrodes. The media sensor circuit provides sensed media signals representative of the presence of media between the first bath of processing liquid and the first sensing electrode as a function of the capacitance between the ground and sensing electrodes.

In other embodiments the media sensor circuit includes a capacitance-to-frequency converter connected between the ground and sensing electrodes. The converter generates a frequency modulated sensed media signal as a function of the capacitance between the ground and sensing electrodes. A decoder circuit coupled to the sensor circuit decodes the sensed media signals and provides digital media detection signals representative of the presence of media. The decoder circuit includes a frequency-to-voltage converter connected to receive the frequency modulated sensed media signals, and generates a voltage modulated signal as a function of the frequency modulated signal. A sensed media voltage source provides a sensed media reference voltage representative of detected media. A first comparator is coupled to the frequency-to-voltage comparator and to the reference voltage source. The comparator compares the voltage modulated sensed media signals to the reference voltage and provides the digital media detection signals as a function of the comparison.

In still other embodiments, the media position sensing system is configured for use in conjunction with a media processor which includes a second processing tank for holding a second bath of conductive media processing liquid, and a media transport mechanism for transporting the media between the first and second tanks. This embodiment of the position sensing system includes a second sensing electrode adjacent to the second processing tank, and a second ground electrode within the second processing tank. A second capacitive media sensor circuit is connected between the second ground and sensing electrodes, and provides sensed media signals representative of the presence of media between the second sensing electrode and the second bath of the processing liquid as a function of the capacitance between the second ground and sensing electrodes. Location processing circuitry coupled to the first and second sensor circuits provides media location signals as a function of the sensed media signals. A display coupled to the location processing circuitry provides a visual display of media positions.

DETAILED DESCRIPTION OF THE PREFERRED EMBODIMENTS

Figure 1:
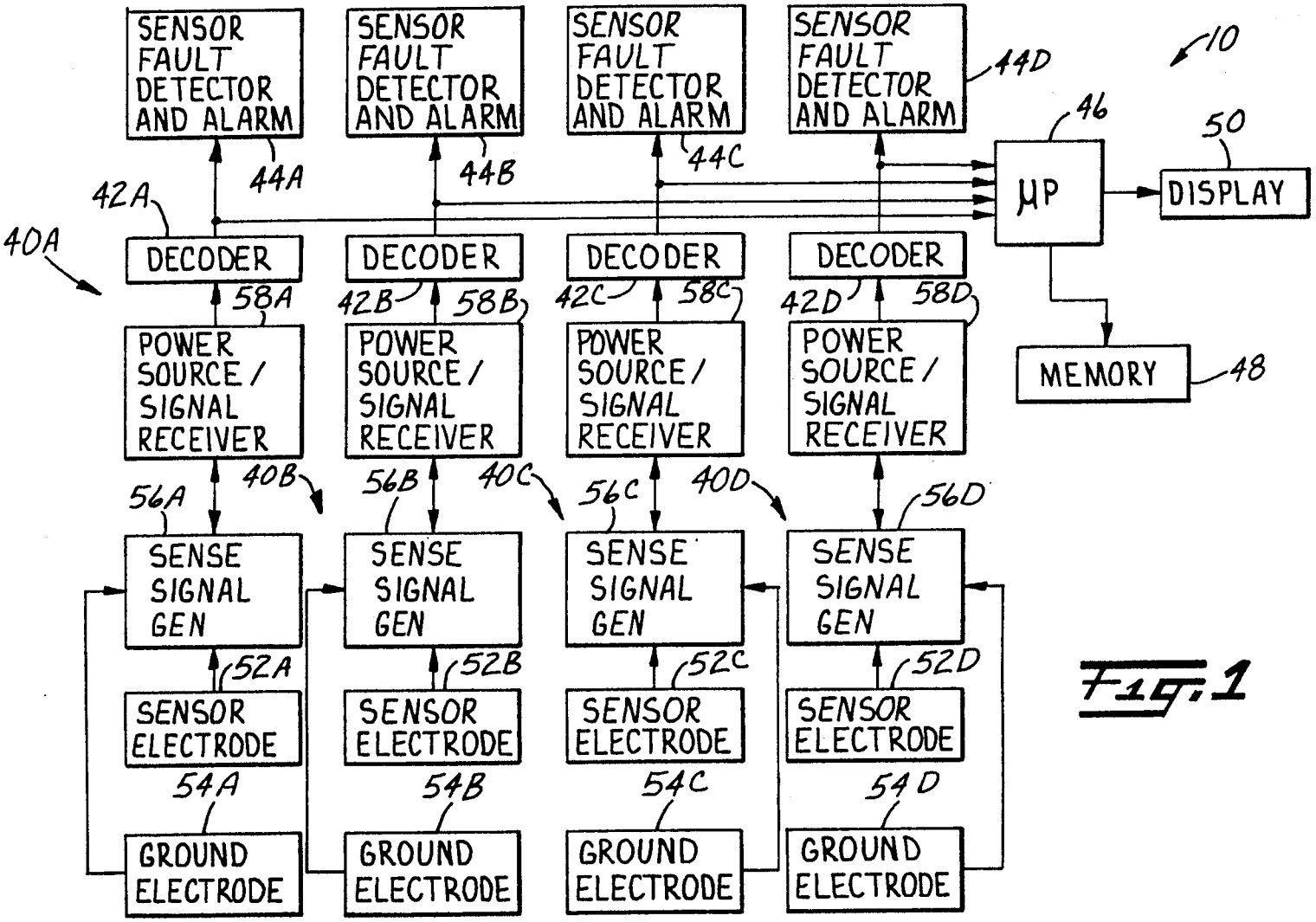
FIG. 1 is a block diagram of a film position sensing system in accordance with the present invention.

A film position sensing system 10 in accordance with the present invention is illustrated generally in FIG. 1. Film position sensing system 10 is configured to provide information regarding the positions of exposed sheets of media such a photographic film as they are driven through developing chemical baths of a processor. The description of film sensing system 10 and its method of operation will therefore be facilitated by a description of an automatic film processor such as that shown at 16 in FIG. 2.

Film processor 16 can be of a known or otherwise conventional design, and typically includes a number of adjacent tanks such as 18A–18D which hold the associated liquid chemical developing baths 14A–14D. Film transport mechanisms 20A–20D are removably positioned within tanks 18A–18D and drive sheets of film 12 through baths 14A–14D, respectively. Transport mechanisms 20A–20D include film entrance nips 24A–24D and film exit nips 28A–28D, respectively. Entrance nips 24A–24D are formed by a pair of driven rollers 22A–22D, respectively. Exit nips 28A–28D are formed by a pair of driven rollers 26A–26D, respectively. Other driven and/or undriven rollers 30A–30D between entrance nips 24A–24D and exit nips 28–28D of respective transport mechanism 20A–20D guide sheets of film 12 through baths 14A–14D along transport paths 32A–32D. Sheets of film 12 are guided between exit nip 28A of transport mechanism 20A and entrance nip 24B of transport mechanism 20B by crossover guide 34A. In a similar manner, sheets of film 12 are guided between transport mechanisms 20B and 20C by crossover guide 34B, and between transport mechanisms 20C and 20D by crossover guide 34C. Crossover guide 34D guides sheets of film 12 to subsequent processing stations (not shown) as the film emerges from bath 14D. Crossover guides 34A–34D are downwardly opening arcuate members which bend the sheets of film 12 as they emerge from exit nips 28A–28D, and direct the sheets of film into the following processing stations.

Figure 2:
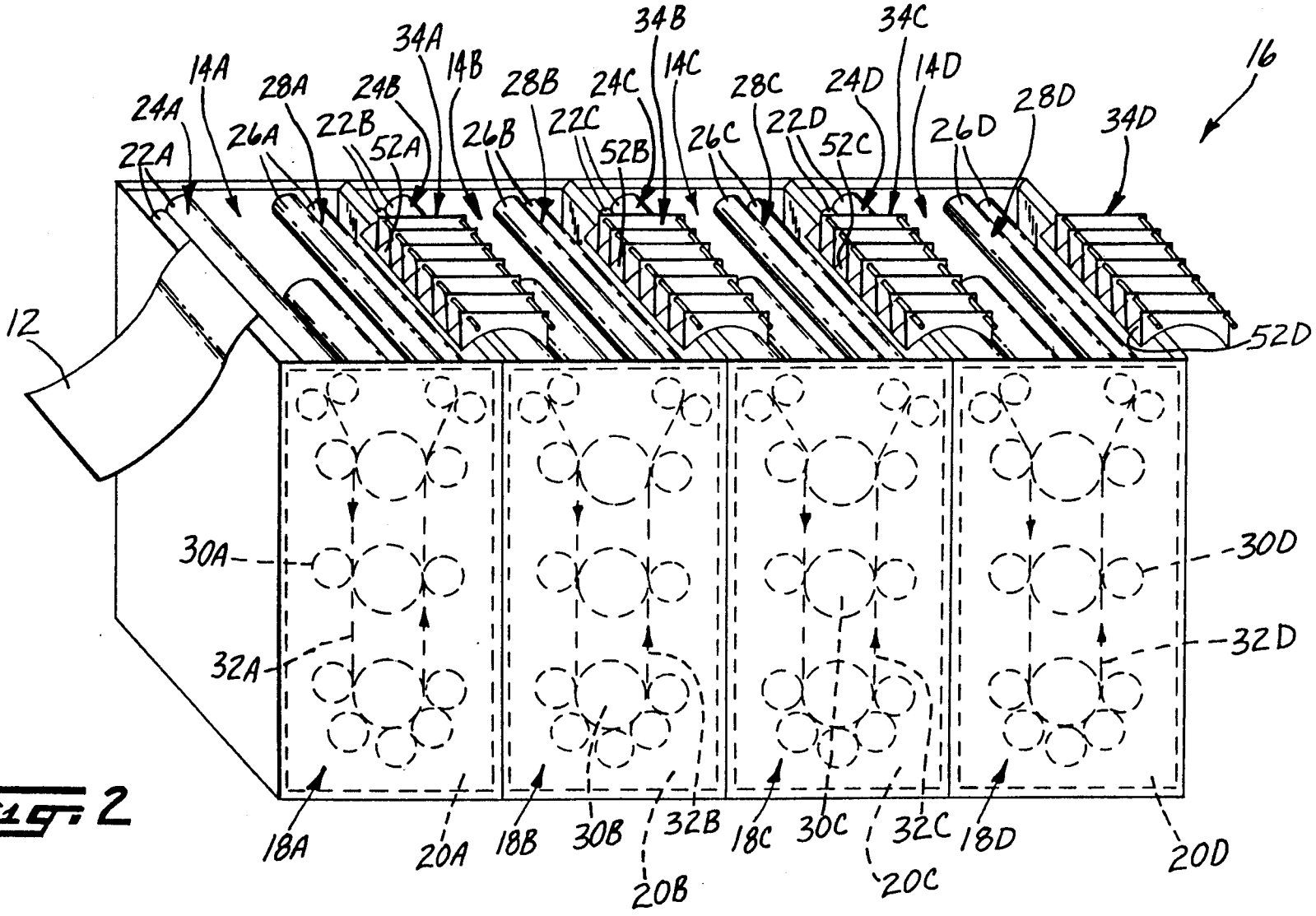
FIG. 2 is an illustration of an automatic film processor with which the position sensing system shown in FIG. 1 can be used.

Film position sensing system 10 includes capacitive sensors 40A–40D, decoders 42A–42D, sensor fault detectors and alarms 44A–44D, microprocessor 46, memory 48 and display 50. Sensors 40A–40D include respective sensing electrodes 52A–52D, ground electrodes 54A–54D, sense signal generators 56A–56D and power source/signal receivers 58A–58D. As shown in FIG. 2, sensing electrodes 52A–52D are positioned on the lower, guiding surfaces of crossover guides 34A–34D. Ground electrodes 54A–54D are positioned within respective tanks 18A–18D (not visible in FIG. 2), and provide electrical contact between baths 14A–14D of processing chemicals and sense signal generators 56A–56D. In one embodiment, electrodes 54A–54D are strips of stainless steel immersed approximately five centimeters below the surface of liquid baths 14A–14D.

The liquid processing chemicals within baths 14A–14D are electrically conductive. Given the distance between sensing electrodes 52A–52D and the respective baths 14A–14D of developing chemicals, the capacitance between associated sensing electrodes 52A–52D and ground electrodes 54A–54D is relatively small when sheets of film 12 are not present between the baths and sensing electrodes (i.e., not near the sensing electrodes). However, the capacitance increases to a relatively high value when the distance between ground electrodes 54A–54D and associated sensing electrodes 52A–52D is reduced by the presence of wet sheets of film 12 between the baths and electrodes. In effect, the wet sheets of film 12 become an extension of the ground electrodes 54A–54D.

Electrical power for sense signal generators 56A–56D is provided by power source/signal receivers 58A–58D, respectively. Frequency modulated sensed media signals representative of the capacitance between associated sensing electrodes 52A–52D and baths 14A–14D, and therefore indicative of the presence of sheets of film 12, are generated by sense signal generators 6A–56D and coupled to decoders 42A–42D through power source/signal receivers 58A–58D. Decoders 42A–42D detect the frequency modulated signals and generate digital film detection signals representative of the presence of sheets of film 12 at respective sensing electrodes 52A–52D. Microprocessor 46 is connected to receive the film detection signals from decoders 42A–42D, and processes the signals in accordance with programs stored in memory 48 to determine the positions of the sheets of film within tanks 18A–18D. With this information microprocessor 46 can drive display 50 in such a manner as to provide an operator with information pertaining to the location of jammed and loose film 12. Sensor fault detectors and alarms 44A–44D monitor the operational status of respective sensors 40A–40D and decoders 42A–42D, and provide the operator with an alarm in the event these portions of film sensing system 10 are malfunctioning.

Figure 3:
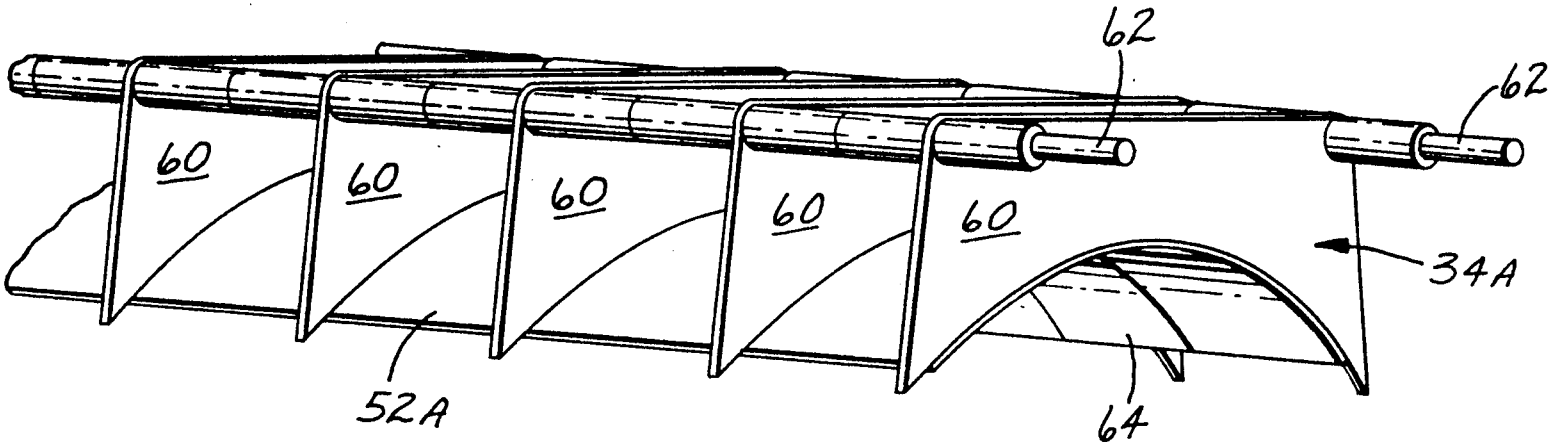
FIG. 3 is a detailed illustration of the crossover guide and sensor electrode shown in FIG. 2.

Crossover guide 34A and sensing electrode 52A can be identical in construction to guides 34B–34D and electrodes 52B–52D, and are described in greater detail with reference to FIG. 3. Crossover guide 34A is formed from a number of plastic guide members 60 which are secured in a parallel, spaced apart arrangement with respect to one another by support rods 62. Sensing electrode 52A is an arcuate stainless steel plate member secured by an adhesive or other fastener (not shown) to the downwardly opening arcuate edges of guide members 60. Sensing electrode 52A is coated with a corrosion and fungus resistant dielectric and insulating material to prevent short circuits with chemical baths 14A–14D through sheets of film 12. Although not shown, the back of electrode 52A and guide members 60 can be encased within potting compound or other encapsulant to prevent splashes from chemical baths 14A–14D from interfering with the capacitance monitoring operation. Strips of low surface tension tape 64 (only one strip is visible in FIG. 3) can be applied to electrode 52A to create ridges along the path of motion over which the sheets of film 12 are guided. These ridges of tape 64 help prevent wet sheets of film 12 from sticking to electrode 52A. Although this function is not shown, support rods 62 can be used to mount crossover guide 34A and electrode 52A in position over tanks 18A and 18B.

Figure 4:
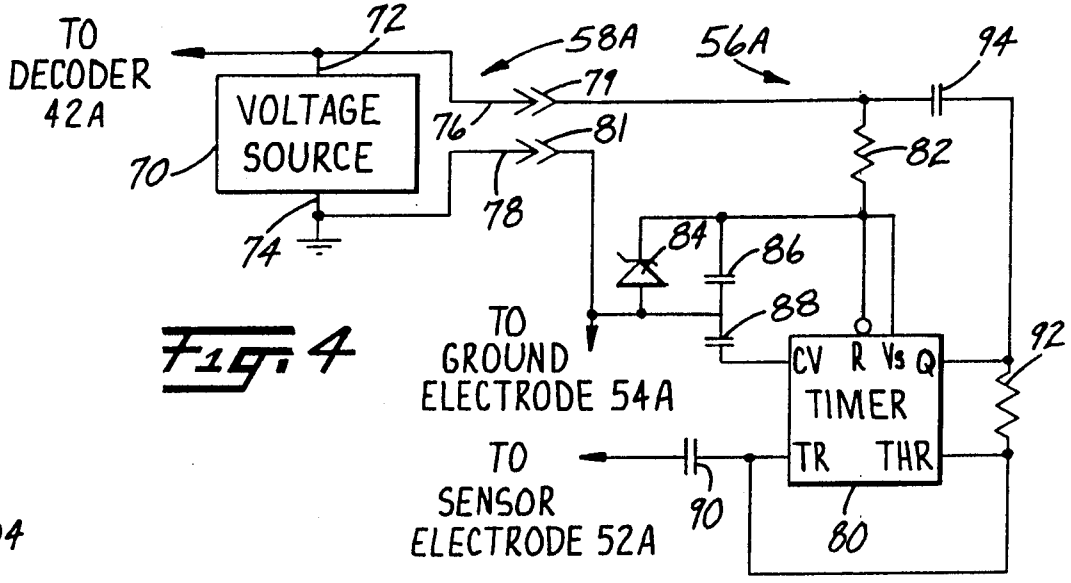
FIG. 4 is a detailed circuit diagram of a sensor shown in FIG. 1.

Sense signal generator 56A and power source/signal receiver 58A can be identical to generators 56B–56D and source/receivers 58B–58D, and are illustrated in greater detail in FIG. 4. Power source/signal receiver 58A includes voltage source 70 for generating a supply potential between positive terminal 72 and ground 74. The supply potential generated by voltage source 70 is coupled to signal generator 56A through conductors 76 and 78 and connectors 79 and 8!. Conductors 76 and 78 can be the conductors in a shielded single conductor cable.

Sense signal generator 56A is a capacitance-to-frequency (C/F) converter and includes integrated circuit timer 80 configured as an astable multivibrator. In one embodiment, timer 80 is a National Semiconductor LMC555 device. To prevent the need for any more than the two conductors 76 and 78 between signal generator 56A and power source/signal receiver 58A, the signal generator is configured to both receive power from and provide the frequency modulated output signal to the power source/signal receiver over conductors 76 and 78. The positive supply potential received from voltage source 70 over conductor 76 is coupled to the reset terminal R of timer 80 through resistor 82. The parallel combination of Zener diode 84 and capacitor 86 functions as a voltage regulator and is interconnected between ground electrode 54A and both the reset terminal R and supply voltage terminal VS of timer 80. The controlled voltage terminal CV of timer 80 is coupled to ground electrode 54A and conductor 78 of power source/signal receiver 58C through capacitor 88. Sensing electrode 52A is coupled to the trigger terminal TR of timer 80 through series capacitor 90. Capacitor 90 has a capacitance value which is relatively large with respect to the capacitance being measured between the sensor electrode 52A and ground electrode 54A, and is a 0.22 μf capacitor in one embodiment. The trigger terminal TR is coupled directly to threshold terminal THR. Threshold terminal THR is interconnected to output terminal Q of timer 80 through resistor 92. The timer output terminal Q is coupled to conductor 76 through capacitor 94.

Timer 80 produces an output signal at its terminal Q which is frequency modulated as a function of the sensed capacitance between sensing electrode 52A and ground electrode 54A. Since the capacitance between sensing electrode 52A and ground electrode 54A will vary as a function of the proximity of sheets of film 12 to the sensing electrode, the frequency of the output signal is indicative of the presence of the film. The frequency modulated output signal produced by timer 80 is coupled back to power source/signal receiver 58A over conductor 76 through capacitor 94.

In one embodiment, power source/signal receiver 58A produces an eight volt DC potential. Resistor 82, diode 84 and capacitor 86 are configured to present a regulated 3.6 volt potential to the reset terminal R and voltage supply terminal VS of timer 80. Values of capacitor 90 and resistor 92 are selected in such a manner that the frequencies of the output signals produced by timer 80 vary over a relatively large range with the increased capacitance between sensing electrode 52A and ground electrode 54A. In one embodiment, the output signals vary between a frequency of 20 K Hz when sheets of film 12 are not present between sensing electrode 52A and ground electrode 54A, and a frequency of 600 Hz when a wet sheet is present near the sensing electrode. Signal generator 56A can be encased within corrosion resistant potting compound (not shown) and mounted to the upper surface of electrode 52A to prevent reactions from splashed baths 14A–14C. The output signals have an amplitude of one to two volts and are modulated onto the 8 volt supply generated by voltage source 70.

Figure 5:
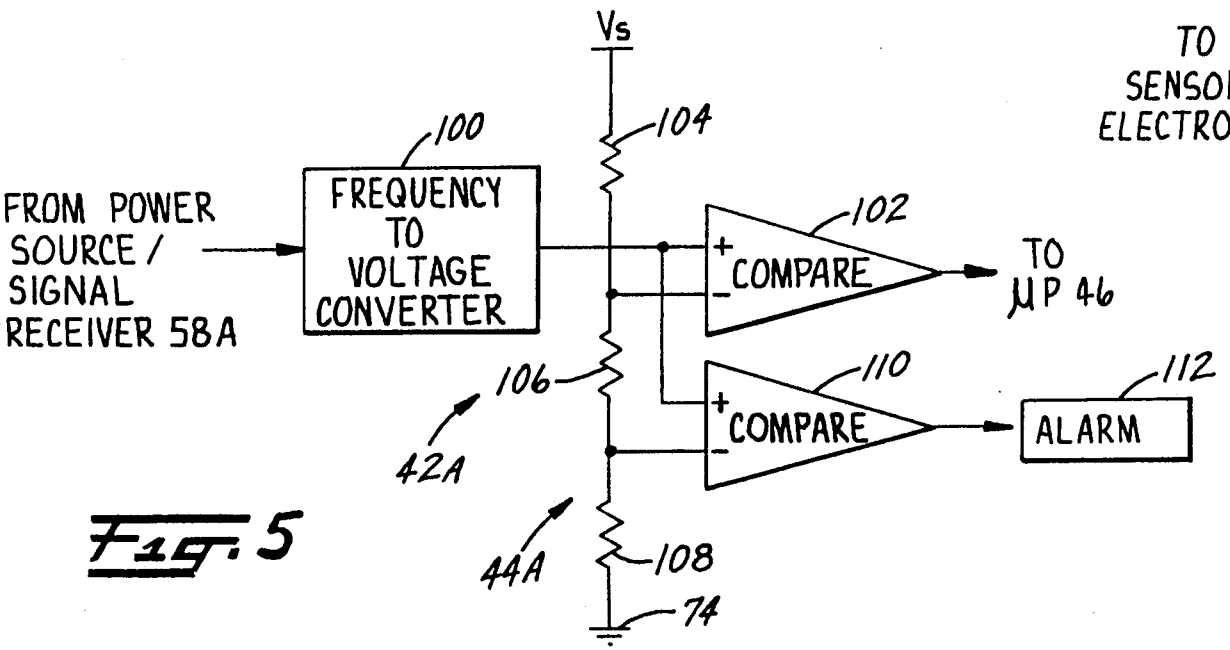
FIG. 5 is a detailed circuit diagram of a decoder and a sensor fault detector and alarm shown in FIG. 1.

Decoder 42A and sensor fault detector and alarm 44A are identical to their counterparts 42B–42D and 44B–44D, and are illustrated in greater detail in FIG. 5. Decoder 42A includes frequency-to-voltage converter 100 and comparator 102. Frequency-to-voltage converter 100 is connected to receive the frequency modulated sensor signals from power source/signal receiver 58A, and produces voltage amplitude modulated output signals as a function of the frequencies of the sensor signals. The voltage output signals are applied to the noninverting (+) input terminal of comparator 102. A sensed film reference voltage is applied to the inverting (−) input terminal of comparator 102. The sensed film reference voltage is produced by a voltage divider formed by resistors 104, 106, and 108 interconnected in a series circuit between the supply of potential Vs and ground terminal 74. The sensed film reference voltage is a voltage well below that which will be produced by frequency-to-voltage converter 100 when no film 12 is present near sensing electrode 52A, yet above the voltage level to which the frequency-to-voltage converter output will drop when the film is present near the sensing electrode. Digital film detection signals will thereby be produced by comparator 102 and coupled to microprocessor 46. As a result of the large dynamic range of the sensed media signals by signal generator 56A, the film detection signals will accurately indicate the detected presence of sheets of film 12.

Sensor fault detector and alarm 44A includes comparator 110 and alarm 12. The non-inverting (+) input terminal of comparator 110 is connected to receive the voltage output signals from frequency-to-voltage converter 100. The inverting (−) input terminal of comparator 110 is connected between voltage divider resistors 106 and 108 to receive a sensor fault reference voltage. The sensor fault reference voltage is a voltage below that which frequency-to-voltage converter 100 would produce in response to the presence of sheets of film 12 between sensing electrode 52A and ground electrode 54A. Sensor fault signals will thereby be produced at the output of comparator 110 when sense signal generator 56A or converter 100 are not functioning properly (e.g., when the signal generator is inoperative and provides no signal to the fault detector and alarm). Alarm 112, which can be a visual or audible alarm, is activated in response to the sensor fault signals to alert the operators of film processor 16.

Film detection signals representative of the sensed presence of sheets of film 12 being transported between tanks 18A and 18B, 18B and 18C, 18C and 18D, and from tank 18D are provided to microprocessor 46 by decoders 42A–42D, respectively. Program data characterizing the length of transport paths 32A–32D, the speed at which film 12 is transported over these transport paths, or other information characterizing the expected time required for the film to travel between any given sensors 40A–40D, is stored in memory 48. By evaluating the presence, absence and sequence of the detection signals received from detectors 42A–42D as a function of the information stored in memory 48, microprocessor 46 can track the locations of sheets of film 12 within processor 16. Microprocessor 46 can thereby isolate the film jams and locations of loose film to specific tanks 18A–18D. This information can be provided to an operator by means of visual display 50. Alternatively, microprocessor 46 can cause display 50 to provide a visual indication of the detected presence of sheets of film 12 at various locations within processor 16.

Figure 6:
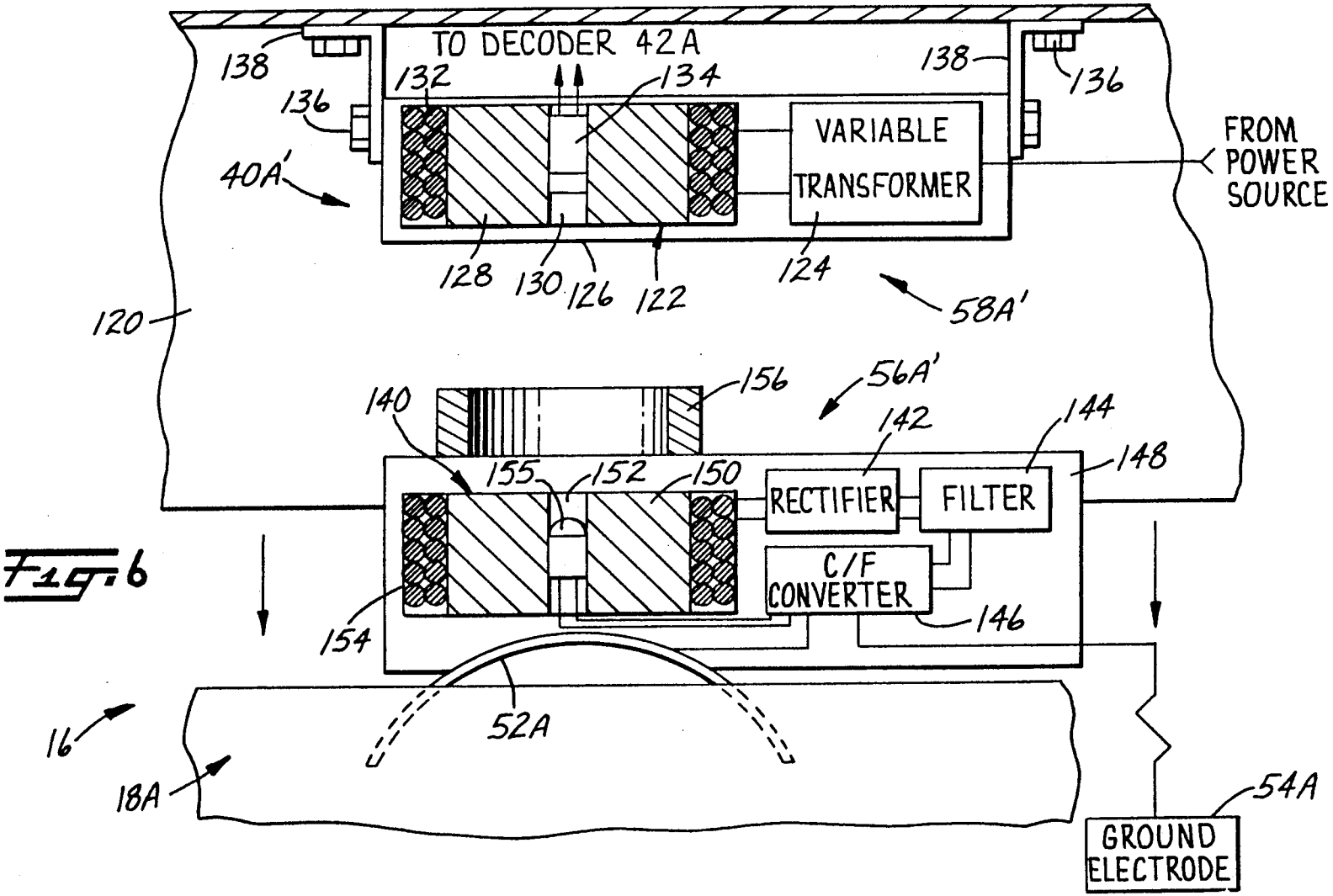
FIG. 6 is a diagrammatic and block diagram representation of an alternative embodiment of a sensor shown in FIG. 1, and the manner in which it is mounted to the film processor shown in FIG. 2

Sensor 40A' an alternative embodiment of sensor 40A, is illustrated in FIG. 6. Sensor 40A' includes power source/signal receiver 58A' and sense signal generator 56A'. Like their counterparts in sensor 40A described above, power source/signal receiver 58A' and sense signal generator 56A' cooperate to produce sensed media signals which are coupled to decoder 42A. However, unlike their counterparts, there are no physical electrical interconnections between power source/signal receiver 58A' and sense signal generator 56A'. Sense signal generator 56A' is fixedly mounted to sensor electrode 52A, while power source/signal receiver 58A' is mounted to a cover 120 which removably encloses the top of tanks 18A–18D. Since there are no electrical interconnections, cover 120 and the power source/signal receivers such as 58A' mounted thereto can be easily removed from processor 16 to permit access to tanks 18A–18D and transport mechanisms 20A–20D.

Power source/signal receiver 58A' includes a solenoid unit 122 and AC transformer 124 sealed within chemical resistant potting compound 126 Solenoid 122 includes a circular magnetically soft core 128 With an aperture 130 extending through its center. A coil 132 is wound around the outer edge of core 128, and is electrically connected to AC transformer 124. AC transformer 124 is powered by a conventional 120 VAC source (not shown). Photodiode 134 is mounted within core aperture 130, and is coupled to decoder 42A. Fasteners such as bolts 136 and brackets 138 can be used to mount power source/signal receiver 58A' to the inside of cover 120.

Sense signal generator 56A' includes relay coil assembly !40, rectifier 142, filter 144 and C/F (capacitance-to-frequency) converter 146, all of which are sealed within corrosion resistant potting material 148. Relay coil assembly 140 includes a generally cylindrical magnetically soft core 150 with an aperture 152 extending through its center. A coil 154 is wound around the outer edge of core 150 and is electrically interconnected to rectifier 142. Filter 144 couples rectifier 142 to C/F converter 146. A light emitting diode (LED) 155 is mounted within aperture 152 and electrically coupled to C/F converter 146. C/F converter 146 is also interconnected to sensing electrode 52A and ground electrode 54A. An annular flexible seal 156 is mounted to signal generator 56A' above relay coil assembly 140.

Solenoid assembly 122 of power source/signal receiver 58A' and relay coil assembly 140 of signal generator 56A' are positioned with respect to one another in such a manner that photodiode 134 and LED 155 will be optically aligned when cover 120 is positioned on film processor 16. Potting materials 126 and 148 must be capable of propagating the radiation produced by LED 155 (e.g., be sufficiently transparent). Alternatively, other optical elements (such as lenses, not shown) can be positioned within potting compound 126 and 148 to create an optical path between LED 155 and photodiode 134.

When cover 120 is positioned on film processor 16, power source/signal receiver 58A' will meet and compress seal 156 to prevent splashes from baths 14A–14D from interfering with the optical path between LED 155 and photodiode 134. In response to the AC power provided by transformer 124, coil 132 sets up a fluctuating magnetic field about core !28. The field about core 128 is impinged upon core 150 and causes an alternating current flow through coil 154. The AC current flow from coil !54 is conditioned by rectifier 142 and filter 144 to generate a DC supply potential which is applied to C/F converter 146. C/F converter 146 can be a multivibrator circuit similar to that of signal generator 56A described above, and generates frequency modulated signals as a function of the capacitance between sensing electrode 52A and ground electrode 54A. LED 155 is driven by the frequency modulated output signals of C/F converter 146. The frequency modulated light beam generated by LED 155 is optically propagated to photodiode 134. The output of photodiode 134 is a frequency modulated signal which is representative of the capacitance between sensing electrode 52A and ground electrode 54A, and therefore the presence of sensed sheets of film 12. The signal from photodiode 134 is coupled to decoder 42A and can be subsequently processed in a manner identical to that described above.

Film position sensing system 10 offers a number of significant advantages. The precise locations of jammed and loose film are identified and provided to the film processor operator. The operator can therefore correct the condition with a minimum amount of inconvenience and lost time. Since the precise location of the jammed and missing film conditions are identified, other unaffected film need not be disturbed. The capacitive sensing mechanism has a large range of resolution and is therefore highly accurate. The sensing mechanism detects the film in a nondestructive manner, and is resistant to the effects of the corrosive environment in which it is used. The sensing system is also efficiently interfaced to the film processor.

Although the present invention has been described with reference of preferred embodiments, those skilled in the art will recognize that changes may be made to form a detail without departing from the spirit and scope of the invention.

What is claimed is:

1. A media position sensing system for use in conjunction with a media processor of the type including a first processing tank for holding a first bath of conductive media processing liquid, comprising:

a first sensing electrode adjacent to the processing tank;

a first ground electrode within the tank, for making electrical contact with the first bath of processing liquid in the tank; and a first capacitive media sensor circuit coupled between the ground and sensing electrodes, for providing sensed media signals representative of the presence of media between the first sensing electrode and first bath of processing liquid as a function of the capacitance between the first ground electrode and first sensing electrode.

2. The media position sensing system of claim 1 wherein in the media sensor circuit includes a capacitance-to-frequency converter connected between the ground and sensing electrodes, for generating frequency modulated sensed media signals as a function of the capacitance between the ground and sensing electrodes.

3. The media position sensing system of claim 2 and further including a decoder circuit coupled to the capacitance-to-frequency converter for decoding the frequency modulated signals and providing digital media detection signals representative of the presence of media.

4. The media position sensing system of claim 3 wherein the decoder circuit includes:

a frequency-to-voltage converter connected to receive the frequency modulated signals, for generating voltage modulated signals as a function of the frequency modulated signals;

a sensed media voltage source for providing a sensed media reference voltage representative of detected media; and a first comparator coupled to the frequency-to-voltage converter and the sensed media voltage source, for comparing the voltage modulated signals to the reference voltage and providing the digital media detection signals as a function of the comparison.

5. The media position sensing system of claim 2 and further including a first sensor fault detection circuit coupled to the media sensor circuit, for providing sensor fault signals representative of a faulty sensor circuit.

6. The media processing system of claim 5 wherein the sensor fault detection circuit includes:

a frequency-to-voltage converter connected to receive the frequency modulated signals, for generating voltage modulated signals as a function of the frequency modulated signals;

a faulty sensor reference voltage source for providing a faulty sensor reference voltage representative of a faulty sensor circuit; and a faulty sensor comparator coupled to the frequency-to-voltage converter and to the faulty sensor reference voltage source, for comparing the voltage modulated signals to the reference voltage and providing the sensor fault signals as a function of the comparison.

7. The media position sensing system of claim 5 and further including an alarm connected to the sensor fault detection circuit.

8. The media position sensing system of claim 1, wherein the system is configured for use in conjunction with a media processor further including a second processing tank for holding a second bath of conductive media processing liquid and a media transport mechanism for transporting the media between the first and second tanks, the position sensing system further comprising;

a second sensing electrode adjacent to the second processing tank;

a second ground electrode within the second processing tank, for making electrical contact with the second bath of processing liquid in the tank;

a second capacitive media sensor circuit connected between the second ground and second sensing electrodes, for providing sensed media signals representative of the presence of media between the second sensing electrode and second bath of processing liquid as a function of the capacitance between the second ground and sensing electrodes; and location processing circuitry coupled to the first and second sensor circuits for providing media location signals as a function of the sensed media signals.

9. The media position sensing system of claim 8 wherein the location processing circuitry includes:

memory for storing timing data characterizing expected media transport times between the first and second sensing electrodes;

a timer; and a processor coupled to the memory, timer and first and second media sensor circuits, for providing the media location signals as a function of the sensed media signals and timing data.

10. The media position sensing system of claim 8 and further including a display for providing a visual display of media locations.

11. The media position sensing system of claim 8 and further including:

a media guide mounted adjacent the first and second processing tanks for guiding the media between the tanks; and a mount for mounting the second sensing electrode to the media guide.

12. The media processing system of claim 1 wherein the sensing electrode includes conductive metal coated with insulating material.

13. A media processing system, including:

a plurality of media processing tanks for holding baths of conductive media processing liquid;

a media transport mechanism for transmitting the media through and between the processing tanks;

a plurality of sensing electrodes, each electrode positioned adjacent to a processing tank;

one or more ground electrodes within the processing tanks for making electrical contact with the baths of processing liquid;

a plurality of media sensor circuits, each connected between a ground electrode and one of the sensing electrodes, for providing sensed media signals representative of the presence of media between the sensing electrodes and adjacent processing liquid baths as function of the capacitance between the sensor electrodes and ground electrodes; and location identifying circuitry coupled to the media sensor circuits, for providing media location signals representative of media locations in the processing tanks as a function of the sensed media signals.

14. The media processing system of claim 13 wherein the media sensor circuits include capacitance-to-frequency converters connected between the associated ground and sensing electrodes, for generating frequency modulated sensed media signals as a function of the capacitance between the ground and sensing electrodes.

15. The media processing system of claim 14 and further including decoder circuits coupled between the sensor circuits and the location identifying circuitry, for decoding the frequency modulated sensed media signals and providing digital media detection signals representative of the presence of media.

16. The media processing system of claim 15 wherein the decoder circuits include:

a frequency-to-voltage converter connected to receive the frequency modulated sensed media signals, for generating voltage modulated signals as a function of the frequency modulated signals;

a sensed media voltage source for providing a sensed media reference voltage representative of detected media;

a first comparator coupled to the frequency-to-voltage converter and the reference voltage source, for comparing the voltage modulated sensed media signals to the reference voltage and providing the digital media detection signals as a function of the comparison.

17. The media processing system of claim 14 and further including sensor fault detector circuits coupled to the media sensor circuits, for providing sensor fault signals representative of faulty sensor circuits.

18. The media processing system of claim 17 wherein the sensor fault detector circuits include:

a frequency-to-voltage converter connected to receive the frequency modulated sensed media signals, for generating voltage modulated signals as a function of the frequency modulated signals;

a faulty sensor reference voltage source for providing a faulty sensor reference voltage representative of a faulty sensor circuit;

a faulty sensor comparator coupled to the frequency-to-voltage comparator and to the faulty sensor reference voltage source, for comparing the voltage modulated signals to the reference voltage and providing the sensor fault signals as a function of the comparison.

19. The media processing system of claim 17 and further including alarms connected to the sensor fault detection circuits.

20. The media processing system of claim 13 wherein the location identifying circuitry includes:

memory for storing timing data characterizing expected media transport times between the sensing electrodes;

a timer; and a processor coupled to the memory, timer and media sensor circuits, for providing the media location signals as a function of the sensed media signals and the timing data.

21. The media processing system of claim 20 and further including a display for providing a visual display of media locations.

22. The media processing system of claim 13 and further including:

crossover guides for guiding the media between tanks; and mounts for mounting the sensing electrodes to the crossover guides.

23. The media processing system of claim 22 wherein the sensing electrodes include conductive metal coated with insulating material.

* * * * *